US008919263B2

(12) United States Patent
Jeong

(10) Patent No.: US 8,919,263 B2
(45) Date of Patent: Dec. 30, 2014

(54) PORTABLE ASSEMBLY-TYPE FLAT BENCH

(76) Inventor: Eun Ji Jeong, Gyeonggi-do (KR)

( * ) Notice: Subject to any disclaimer, the term of this patent is extended or adjusted under 35 U.S.C. 154(b) by 265 days.

(21) Appl. No.: 13/263,337

(22) PCT Filed: Mar. 12, 2010

(86) PCT No.: PCT/KR2010/001554

§ 371 (c)(1),
(2), (4) Date: Oct. 6, 2011

(87) PCT Pub. No.: WO2010/117144

PCT Pub. Date: Oct. 14, 2010

(65) Prior Publication Data

US 2012/0031311 A1 Feb. 9, 2012

(30) Foreign Application Priority Data

Apr. 6, 2009 (KR) ..... 10-2009-0029591

(51) Int. Cl.

| | |
|---|---|
| ***A47B 47/00*** | (2006.01) |
| ***A47C 11/00*** | (2006.01) |
| ***A47B 13/08*** | (2006.01) |
| ***A47C 19/02*** | (2006.01) |
| ***A47B 91/00*** | (2006.01) |
| ***A47C 19/00*** | (2006.01) |
| ***A47C 17/64*** | (2006.01) |

(52) U.S. Cl.

CPC ..... *A47C 19/025* (2013.01); *A47C 11/00* (2013.01); *A47B 13/088* (2013.01); *A47B 91/00* (2013.01); *A47C 19/005* (2013.01); *A47C 17/645* (2013.01)

USPC ..... 108/64; 52/263

(58) Field of Classification Search

CPC ..... A47B 13/088; A47B 91/00; A47B 2003/0821; A47B 87/002; A47C 11/00; A47C 19/025; A47C 19/005; A47C 17/645

USPC ..... 312/107, 108, 111; 182/151, 222, 182/181.1; 248/188.1; 52/6, 7, 263, 125.5, 52/125.6; 135/137, 116; 108/64, 65, 108/157.1, 157.17, 128

See application file for complete search history.

(56) References Cited

U.S. PATENT DOCUMENTS

| | | | | |
|---|---|---|---|---|
| 2,403,338 A * | 7/1946 | Butler | ..... | 108/64 |
| 2,502,526 A * | 4/1950 | Loewen | ..... | 108/101 |
| 2,875,008 A * | 2/1959 | Grodsky | ..... | 108/62 |

(Continued)

FOREIGN PATENT DOCUMENTS

| | | |
|---|---|---|
| DE | 2314463 A1 | 2/1975 |
| JP | 09-075137 | 3/1997 |

(Continued)

OTHER PUBLICATIONS

International Search Report for PCT/KR2010/001554 Mailed on Aug. 25, 2010.

*Primary Examiner* — Janet M Wilkens
(74) *Attorney, Agent, or Firm* — Revolution IP

(57) ABSTRACT

A portable assembly type flat bench in which a plurality of supports are spaced apart from each other by an equal spacing in the front and rear directions and left and right directions, and interconnected through a connection panel, to thereby reduce the volume of the bench and to thus enable easy carrying and storage, and easy assembly and disassembly, and to enable the size of the bench to be freely adjusted.

16 Claims, 8 Drawing Sheets

(56) References Cited

U.S. PATENT DOCUMENTS

| | | | | | |
|---|---|---|---|---|---|
| 3,158,003 | A * | 11/1964 | Dally | 52/591.3 |
| 3,714,906 | A * | 2/1973 | Finestone | 108/64 |
| 4,922,835 | A * | 5/1990 | Van Vliet et al. | 108/185 |
| 4,998,599 | A * | 3/1991 | Wang | 182/160 |
| 5,341,750 | A * | 8/1994 | Fuchs | 108/64 |
| 5,353,716 | A * | 10/1994 | Wilbert | 108/150 |
| 5,568,775 | A * | 10/1996 | Rizzi et al. | 108/64 |
| 7,192,082 | B2 * | 3/2007 | Tennian | 297/16.1 |
| 7,509,913 | B1 * | 3/2009 | Eagle | 108/90 |
| 8,176,857 | B2 * | 5/2012 | Ochs | 108/64 |
| 2005/0011419 | A1 * | 1/2005 | Rhoden | 108/64 |
| 2009/0232632 | A1 * | 9/2009 | Baltz | 414/800 |

FOREIGN PATENT DOCUMENTS

| | | |
|---|---|---|
| JP | 2004-270432 | 9/2004 |
| KR | 20-0300950 | 1/2003 |
| KR | 10-2006-0040760 | 5/2006 |

* cited by examiner

PORTABLE ASSEMBLY-TYPE FLAT BENCH

RELATED APPLICATIONS

This application is a 371 application of International Application No. PCT/KR2010/001554, filed Mar. 12, 2010, which in turn claims priority from Korean Patent Application No. 10-2009-0029591, filed Apr. 6, 2009, each of which is incorporated herein by reference in its entirety.

TECHNICAL FIELD

The present invention relates to a portable assembly type flat bench, and more particularly, to a portable assembly type flat bench in which a plurality of supports are spaced apart from each other by an equal spacing in the front and rear directions and left and right directions, and interconnected through a connection panel, to thereby reduce the volume of the bench and to thus enable easy carrying and storage, and easy assembly and disassembly, and to enable the size of the bench to be freely adjusted.

BACKGROUND ART

A flat bench is generally installed indoor as well as outdoor and is a kind of a bed structure on which people can take a rest, with each corner is portion of an underneath surface of a flat panel being equipped with support legs; however its volume and weight are massive and heavy which make movements hard, so the use of the same is not easy.

An assembly and disassembly type flat bench is disclosed, in which a panel, support legs and a frame are be disassembled in order to try to enhance portability; however the volume of a conventional portable flat bench is bulky, which worsens portability, and its assembly performance is bad.

In order to overcome the above problems, the Korean utility model publication number 441590, as shown in FIG. 1, discloses a portable flat bench consisting of a plurality of horizontal frames, vertical frames, a panel and at least one connection part and support legs. A panel mounted on a flat bench frame is divided into four parts thus forming four unit panels. A central frame is provided at a center of a flat bench frame and is in parallel with a horizontal frame of a flat bench frame. Both ends of a central frame are inserted into an upper side-open support fixed at a center of a vertical frame, and a horizontal to frame and a central frame of a flat bench frame are separated into both directions and are connected by a connection frame. An insertion groove is formed at each upper surface of a horizontal frame, a vertical frame and a central frame, respectively. A horizontal protrusion and a vertical protrusion of an outer side formed at an edge portion of an underneath surface of a unit is plane are inserted into the insertion grooves of the horizontal frame and the vertical frame, respectively. A horizontal protrusion of an inner side of an underneath surface of a unit panel is inserted into an insertion groove of the central frame. An accommodation groove is formed at a connection member of both sides of a connector connecting the horizontal frame and the vertical frame and at a center of the connection frame, respectively, so the insertion grooves of the horizontal frame, the vertical frame and the central frame are overlapped on the accommodation grooves, respectively. A corner portion of a unit panel is mounted at an upper surface of the connector. An accommodation groove with an insertion groove is formed at an end formed in a perpendicular direction. An extension pipe accommodating an upper side of a support leg is formed integrally with a connector at a center of an underneath surface of the connector, and a head part is buried in the interior of a center portion of the connector at the center of the extension pipe and is engaged with a screw hole of an upper center of a support leg, and a bolt is disposed in a longitudinal direction of an extension pipe. A head part of an adjusting bolt engaged with an adjusting screw hole of a lower side of a support leg is buried in a central inner portion at a lower side of a support leg. A ground touching support pipe in which an adjusting bolt is vertically fixed at an inner central portion is engaged, thus forming a conventional assembly type flat bench.

The above utility model as registered is not able to diversely change the size of the flat bench, and an assembly and disassembly are not easy, so there is a lot of inconvenience in using as a portable appliance which needs fast assembly and disassembly.

DISCLOSURE OF INVENTION

Accordingly, it is an object of the present invention to provide a portable assembly type flat bench which overcomes the problems of a conventional portable assembly type flat bench. A plurality of supports are spaced apart in front and rear directions and left and right directions and are connected by a connection panel. When it is disassembled, a volume is not bulky, thus obtaining an easier storage. Everyone can easily assemble and disassemble, and the size of a flat bench can be freely adjusted.

The assembly type flat bench is equipped with an engaging member and a fixing strap, thus providing a structurally stable assembly type flat bench. With the aid of a leg support or a leg support at an underneath surface of a support, the flat bench of the present invention can be installed even at a beach with sand.

To achieve the object of the present invention, there is provided a portable assembly type flat bench A in which a plurality of supports 1 are spaced is apart from one another in front and rear directions and left and right directions at regular intervals, and the supports 1 are connected by a connection panel 3, which comprises:

the support 1 which is configured in such a manner that a support leg 12 is integrally disposed at an underneath surface of a base 11, and the support leg 12 is engaged and gradually widened in a direction from the base 11 to the outside, and a support panel 2 is provided at an upper side of the base 11 of the support 1, and the neighboring two supports 1 are connected by means of a connection panel 3, and another connection panel 3 is connected to a space part of the assembly type flat bench connected by means of the connection panel 3.

Advantageous Effects

According to the assembly type flat bench of the present invention, when it is disassembled, a volume is not bulky, thus obtaining a better portability and storage, and everyone can easily assemble and disassemble. If necessary, the size of a flat bench can be freely adjusted.

The assembly type flat bench is formed with an engaging member and a fixing strap, thus obtaining a structurally stable construction. With the aid is of a leg support or a leg support at an underneath surface of a support, the flat bench of the present invention can be installed even at a beach with sand. If necessary, the flat bench of the present invention can be used as a table or a chair. A tent or a shading screen can be installed above the upper side of a flat bench, which leads to a diverse purpose application.

BRIEF DESCRIPTION OF THE DRAWINGS

The present invention will become better understood with reference to the accompanying drawings which are given only by way of illustration and thus are not limitative of the present invention, wherein.

DESCRIPTIONS OF MAJOR ELEMENTS OF DRAWINGS

Figure 1:
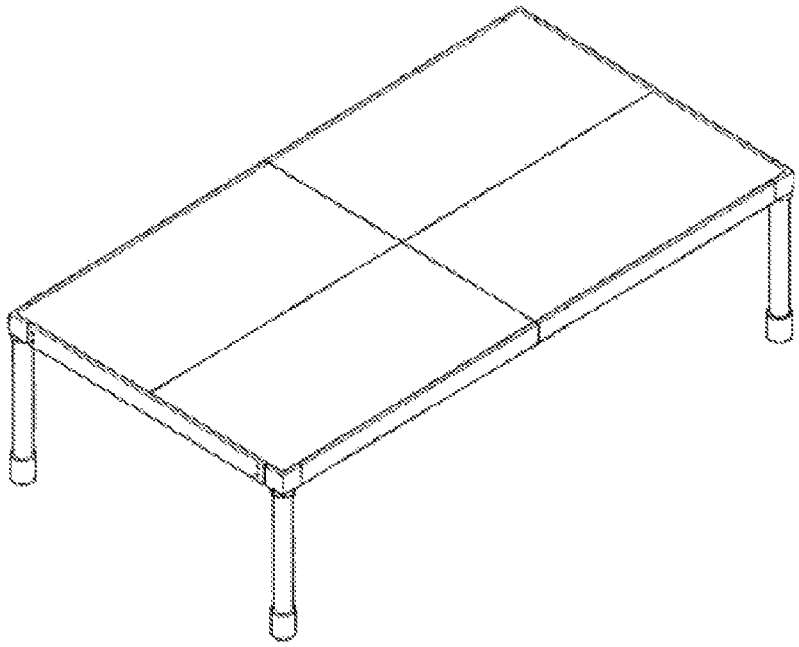
Fig.1 [Prior Art]
FIG. 1 is a perspective view illustrating a conventional assembly type flat bench.

1: support 2: support panel 3: connection panel
4: fixing strap 5: leg support member 6: leg base
11: base
12: support leg 13: assistant member
14: engaging member 15: fixing strap mounting groove
21, 31: longitudinal holes
22, 32: dove tail protrusion 23, 33: dove tail groove
24, 34: engaging protrusion

MODES FOR CARRYING OUT THE INVENTION

The portable assembly type flat bench A according to the present invention will be described with reference to the accompanying drawings.

Figure 2:
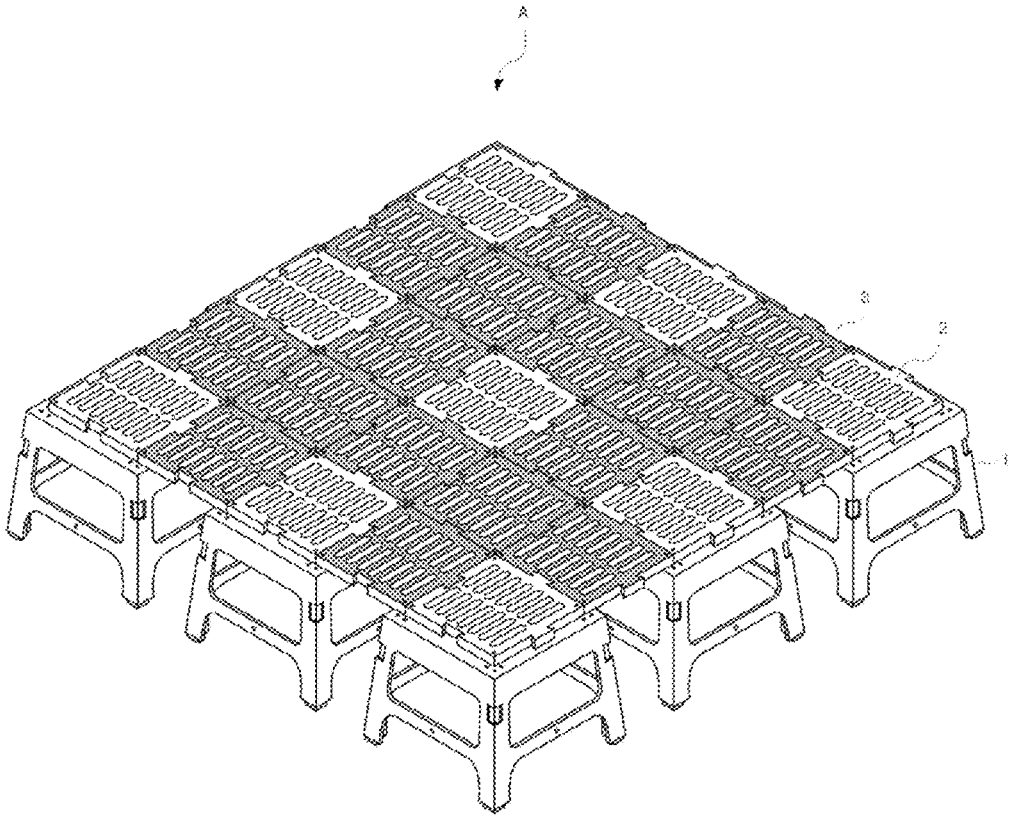
FIG. 2 is a perspective view illustrating a portable assembly type flat bench according to the present invention.

FIG. 2 is a perspective view illustrating a portable assembly type flat bench A according to the present invention, which comprises a plurality of connection parts 1, a support panel 2 provided at an upper side of the support 1, and a connection panel 3 connecting the neighboring supports 1.

Figure 3:
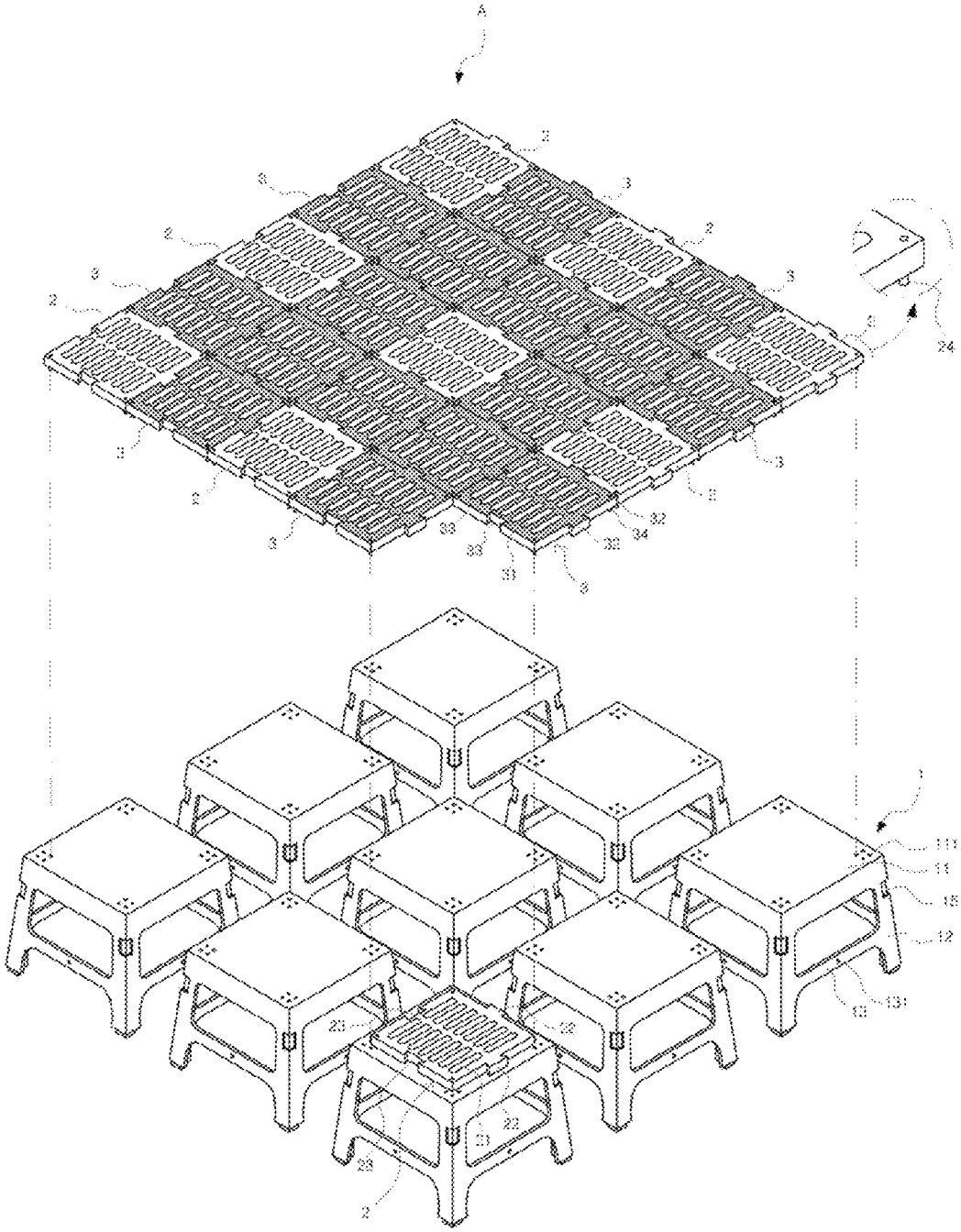
FIG. 3 is a perspective view illustrating a state that a support to panel and a connection panel of a portable assembly type flat bench are separate according to the present invention.
Figure 4:
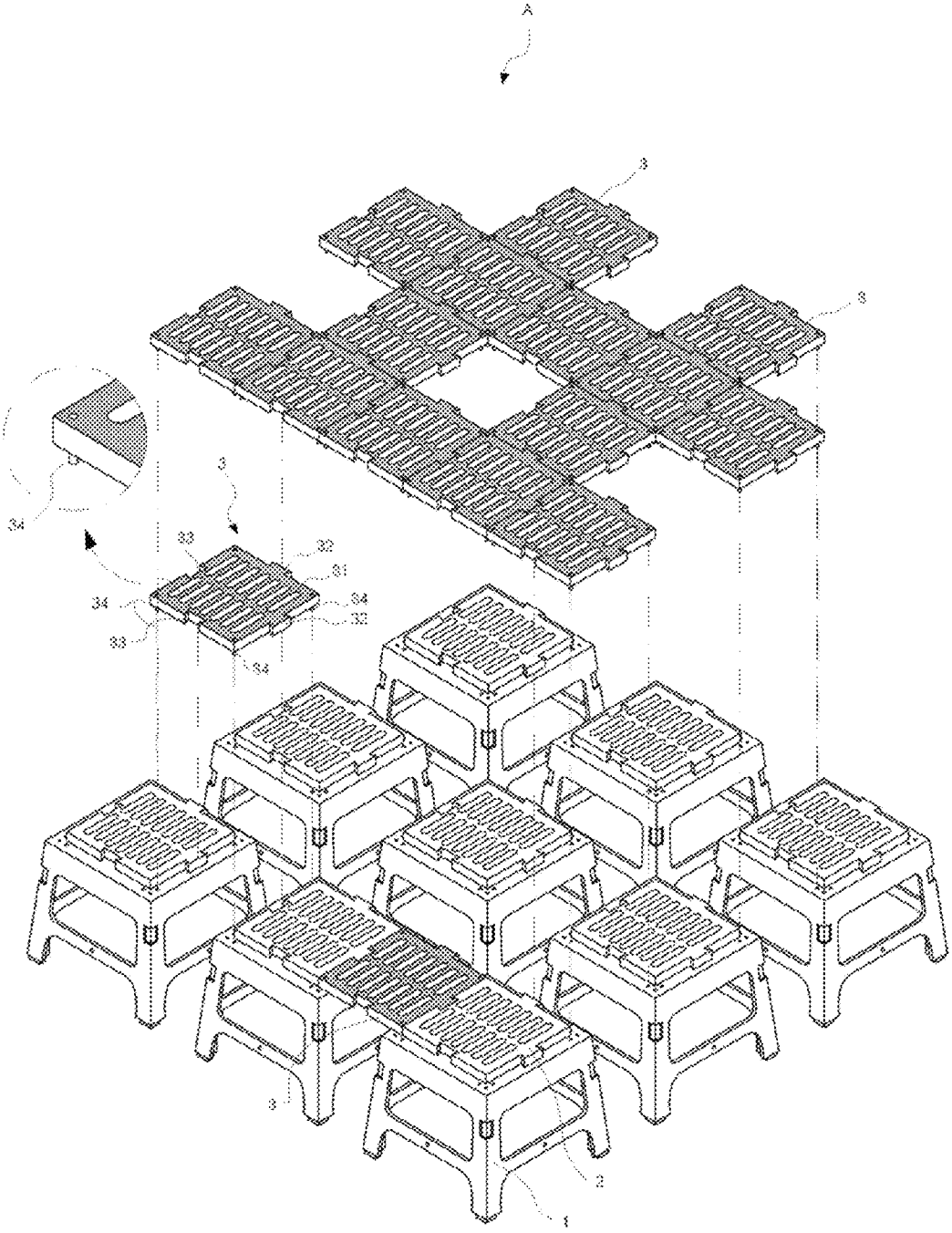
FIG. 4 is a perspective view illustrating a state that a support panel is integrally formed at a support of a portable assembly type flat bench according to the present invention.

At this time, the support 1 is formed of a support leg 12 disposed at an underneath side of a base 11, and a support panel 2 is disposed at an upper side of the base 11. The support panel 2 is seen in the drawing like a rectangular panel; however its construction is not limited thereto. As shown in FIG. 3, the support panel 2 might be engaged like it is separate from the base 11. As shown in FIG. 4, the support panel 2 might be integrally formed at the base 11 of the support 1; however its engaging construction is not limited thereto. The support leg 12 disposed at an underneath surface of the base 11 might be integrally formed at the base 11 or is assembled and engaged; however, its construction is not limited thereto.

The support leg 12 of the support 1 is disposed not at a right angle to the base 11, but in a manner that it is gradually widened from the base 11 to the outer side for the reasons to effectively stack and store the supports 1 when disassembling the assembly type flat bench A.

As shown in FIGS. 3 and 4, the portable assembly type flat bench A according to the present invention is characterized in that the supports 1 are spaced apart from each other in front and rear directions and left and right directions and are connected by a connection panel 3 and are more preferably arranged at regular intervals, and the connection panel 3 connecting the support panel 2 disposed at the upper side of the base 11 of the support 1 and the neighboring two supports 1 have same shapes.

The neighboring two supports 1 are connected by a connection panel 3, and another connection panel 3 is connected in a space of the assembly type flat bench A formed by means of the support panel 2 and the connection panel 3, so the upper sides of the supports 1 as arranged below are all connected with the support panel 2 and the connection panel 3 without spaces.

At this time, the connection of the support panel 2 and the connection panel 3 is made on the base 11 of the support 1. A support panel 2 is disposed at an upper side of the base 11, and the side portions of the support panel 2 and the connection panel 3 are connected at the edge of the base 11. Another connection panel 3 filled in a space between the support panel 2 and the connection panel 3 is engaged to the corner of the base 11 of the other support 1.

Four engaging holes 111 are formed at the corner portions of the base 11 of the support 1, and the support panel 2 and the connection panel 3 are engaged and assembled to the four engaging holes 111. In other words, the engaging protrusions 24 and 34 are formed at a corner lower side of each of the support panel 2 and the connection panel 3, so the engaging protrusions 24 and 34 are inserted into the engaging holes 111 formed at the corner portions of the base 11 of the support 1. Here, the engaging protrusions 24 and 34 might be integral with the support panel 2 and the connection panel 3 or might be installed by passing the engaging part such as a common screw or the like through the upper and lower sides of the panel; however its construction is not limited thereto.

As seen in the drawings, four different panels 2 and 3 are engaged to four engaging holes 111 formed at the corner portions of the base 11.

Dove tail protrusions 22 and 32 are formed at one side surface and is another side surface neighboring with the one side surface in the support panel 2 and the connection panel 3. Dove tail groves 23 and 33 matching with the dove tail protrusions 22 and 32 are formed at side surfaces opposite to the dove tail protrusions 22 and 32. When the dove tail protrusions 22 and 32 and the dove tail grooves 23 and 33 are formed, the dove tail protrusions 22 and 32 of the support panel 2 or the connection panel 3 are inserted into the dove tail grooves 23 and 33 of the neighboring support panel 2 or the connection panel 3 and are assembled, so they don't separate even when an external impact is applied thereto in a horizontal direction.

A plurality of longitudinal holes 21 and 31 passing through from the upper side to the lower side are formed at the support panel 2 and the connection panel 3, respectively, by means of which air can penetrate into the support panel 2 and the connection panel 3, so a user might feel fresh air during hot summer.

Figure 5:
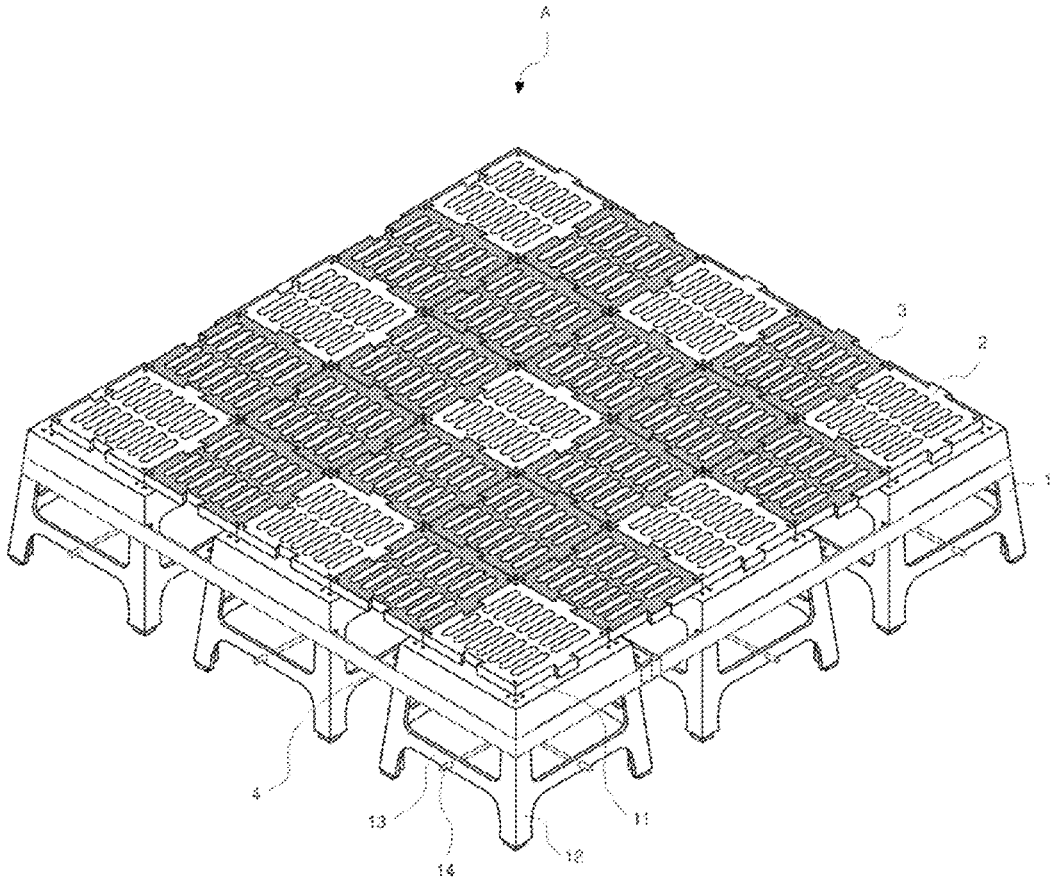
FIG. 5 is a perspective view illustrating a state that an engaging member and a fixing strap are installed at a portable assembly type flat bench according to the present invention.

As shown in FIG. 5, in order to more enhance the engaged force of the assembled portable assembly type flat bench A according to the present invention, the assistant member 13 connecting the support legs 12 are formed at the intermediate portion of the support leg 12 of the support 1, and a through hole 131 is formed at a central portion of the assistant member 13. As the bar shaped engaging members 14 pass through the through holes 131, the supports 1 arranged in front and rear directions and left and right directions are interconnected with one another. The engaging member 14 might be installed through a side surface of the base 11 of the support 1, not by the assistant member 13. A through hole might be formed at a side surface of the base 11, so the engaging member 14 passes through the through hole thus engaging the bench.

There might be further provided a fixing strap 4 surrounding the whole portions of the supports 1 arranged in front and rear directions and left and right directions at regular intervals. It is preferred that a fixing strap mounting groove 15 is formed at an outer side surface of the support leg 12 of the support 1 so that the fixing strap 4 can stably surround the supports 1. The fixing strap mounting groove 15 is not limited to its shape, size or formation position unless the fixing strap 4 is no stably mounted. Both ends of the fixing strap 4 might be tied by means of a buckle or the like or both ends of the same might be tied using a Velcro tape or the like; however their tying way is not limited thereto.

When the portable assembly type flat bench A according to the present invention is positioned at a place with sand or a place with high is moisture after rain, not at a hard ground, a leg support member 5 and a leg base 6 might be provided at an underneath surface of the support leg 12 in order to prevent the support leg 4 of the support 1 from sinking into the sand or ground as the support leg 4 of the support 1 is not stably supported.

Figure 6:
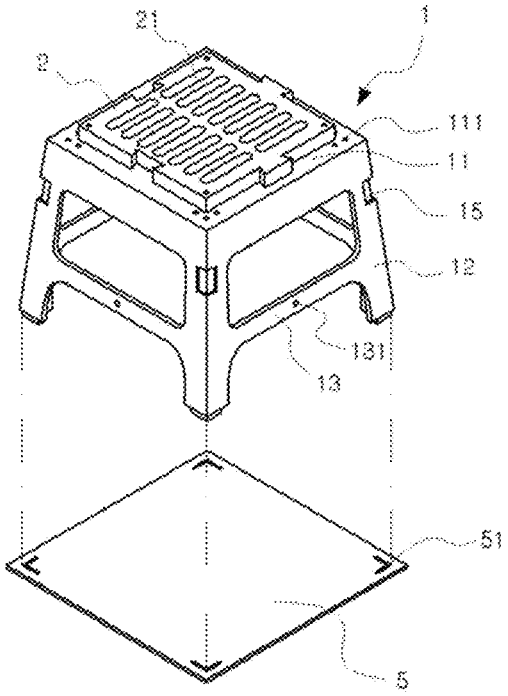
FIGS. 6 and 7 are perspective views illustrating a state that a leg support part is installed at an underneath surface of a support according to the present invention.
Figure 7:
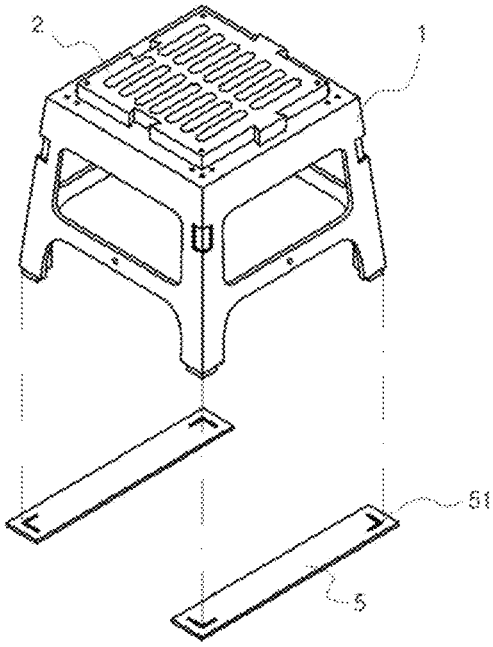

As shown in FIG. 6, the leg support member 5 is made in a flat plate shape, thus supporting four support legs 12 together with one plate. Alternatively, two plates might be used to support two support legs 12. As not shown in the drawings, four support legs 12 might be independently supported; however, its support way is not limited thereto.

A cut-away part 51 configured to match with an end of a support leg 12 might be formed at the leg support member 5, so a stable engagement can be obtained by inserting an end of the support leg 12 into the cut-away part 51. Here, an engaging shoulder might be formed at the support leg 12 in order to prevent the support leg 12 from inserting deep into the cut-away part 51.

Figure 8:
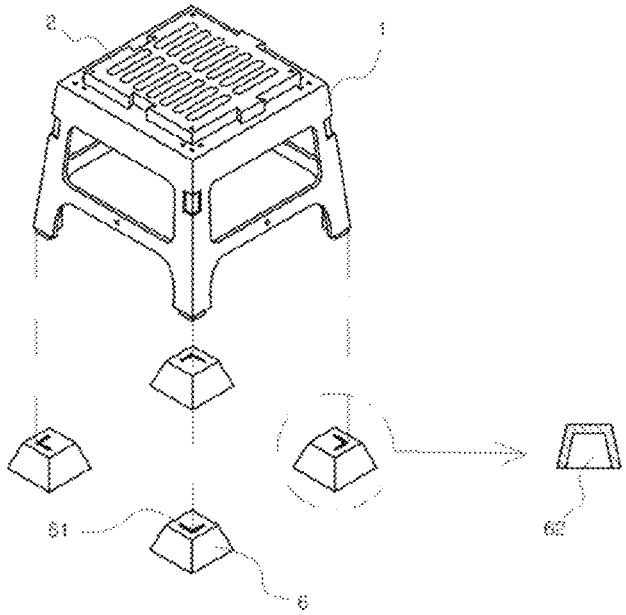
FIG. 8 is a perspective view illustrating a state that a leg support is installed at a underneath surface of a support according to the present invention.

As shown in FIG. 8, the leg base 6 is protruded upwards to have a space part 62 at its lower side. A cut-away part 61 configured to match with an end portion of the support leg 12 might be formed at a protruded upper surface in the same manner as the leg support member 5. In addition, as shown in FIG. 8, one leg base 6 is assigned to each support leg 12; however four cut-away parts 61 might be formed so that one leg base 6 can support all the support legs 12. The above leg base 6 might be useful when the bench is placed at a place with sand. Since sand is filled in the space part 62 of the lower side, it is possible to more stably support the supports 1.

Meanwhile the supports 1, the support panel 2 and the connection panel 3 of the present invention are not limited to their materials; for example, when they are made from plastic materials, it is preferred that reinforcing ribs are integrally formed at a lower side of the panel 2 in order to enhance strength.

Figure 9:
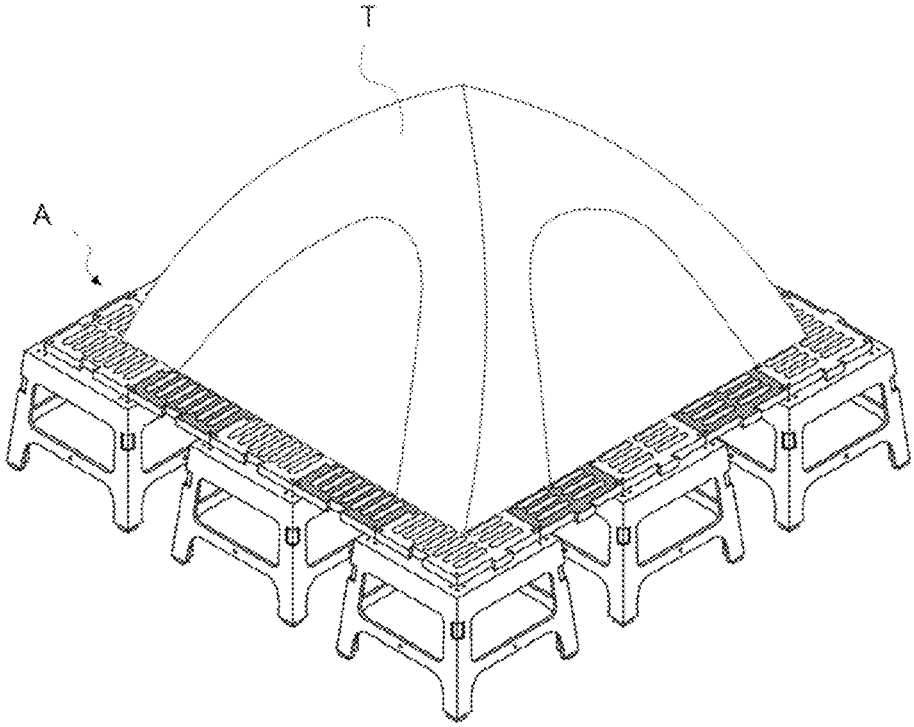
FIGS. 9 and 10 are perspective views illustrating a use state of a portable assembly type flat bench according to the present invention.
Figure 10:
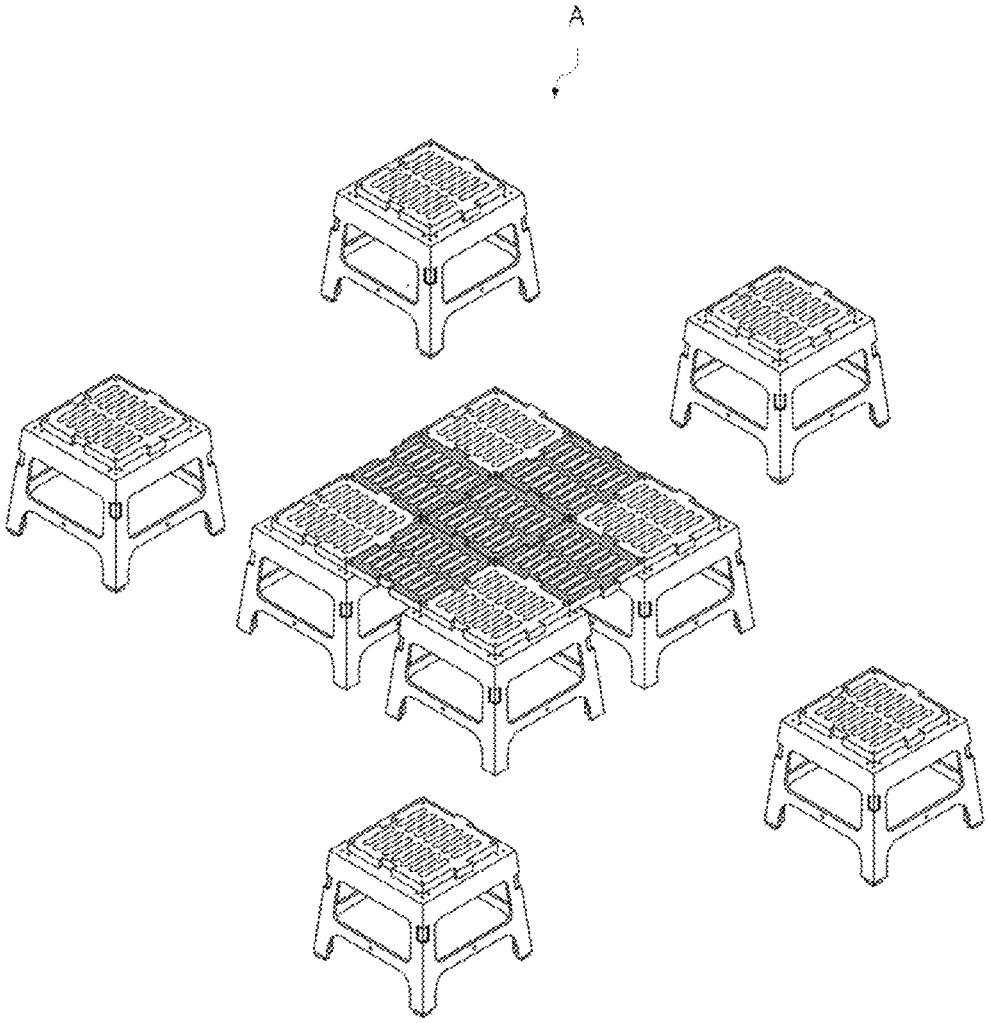

The potable assembly type flat bench A according to the present invention is capable of providing a thing on which people can take a rest and as shown in FIG. 9, a tent T might be installed above the upper side of the portable assembly type flat bench A or a shading screen might be installed, so an applicable range of the present invention is diverse, not limiting thereto.

As shown in FIG. 8, when some of the supports 1, the support panels 2 and the connection panels 3 are connected thus making a table, and some of the supports 1 and the support panels 2 are connected thus making chairs for thereby making an outdoor table set. Some of the connection panels 3 is are connected thus making an outdoor mat.

As not shown in the drawings, a protection member might be installed along an outer edge portion of the portable assembly type flat bench A according to the present invention; however its construction is not limited thereto.

The invention claimed is:

1. A portable assembly type flat bench, comprising:

a plurality of supports are spaced apart from one another in front and rear directions and left and right directions at regular intervals, each of the plurality of supports having a base and a plurality of vertical legs formed downwardly from the base;

a plurality of rectangular support panels, each rectangular support being disposed on a top of each base of the plurality of the supports;

a plurality of first rectangular connection panels, each first rectangular connection panel being interposed between neighboring support panels to contact the neighboring support panels in a side to side manner and to connect the neighboring support panels to each other; and a plurality of second rectangular connection panels, each second rectangular connection panel being interposed between neighboring first connection panels to contact the neighboring first connection panels in a side to side manner and to connect the neighboring first connection panels with each other.

2. The portable assembly type flat bench according to claim 1, wherein at least one of the bases and the at least one support panel being disposed thereon are integral with each other.

3. The portable assembly type flat bench according to claim 2, wherein at least one of the supports has horizontal bridge to connect the plurality of vertical legs, wherein a hole is formed at a central portion of the bridge, and wherein an elongate structure is inserted into the hole of the bridge of the supports to interconnect another of the supports.

4. The portable assembly type flat bench according to claim 2, wherein a plate-shaped leg support member is disposed beneath at least one of the supports, wherein each of the legs of the at least one support is inserted in a cut-away portion formed in the leg support member, wherein a shape of each cut-away portion corresponds to a shape of a bottom of one of the legs.

5. The portable assembly type flat bench according to claim 2, wherein a leg base is engaged at a bottom surface of one of the support legs one of the supports, wherein said leg base is protruded upwards to have a space part in a lower side, and a cut-away part corresponding to a shape of the bottom of the support leg.

6. The portable assembly type flat bench according to claim 1, wherein four holes are formed at each corner of at least one of the bases.

7. The portable assembly type flat bench according to claim 6, wherein the support panel disposed on the at least one base has a first protrusion at one corner thereof to be inserted into a first hole of the four holes, the at least one first connection panel contacting the support panel in the front-rear direction has a second protrusion at one corner thereof to be inserted into a second hole of the four holes, the at least one first connection panel contacting the support panel in the right-left direction has a third protrusion at one corner thereof to be inserted into a third hole of the four holes, and the at least one second connection panel contacting with the first connection panels having the second and third protrusions respectively has a fourth protrusion at one corner thereof to be inserted into a fourth hole of the four holes.

8. The portable assembly type flat bench according to claim 7, wherein at least one of the supports has horizontal bridge to connect the plurality of vertical legs, wherein a hole is formed at a central portion of the bridge, and wherein an elongate structure is inserted into the hole of the bridge of the support to interconnect another of the supports.

9. The portable assembly type flat bench according to claim 7, wherein a plate-shaped leg support member is disposed beneath at least one of the supports, wherein each of the legs of the at least one support is inserted in a cut-away portion formed in the leg support member, wherein a shape of each cut-away portion corresponds to a shape of a bottom of one of the legs.

10. The portable assembly type flat bench according to claim 7, wherein a leg base is engaged at a bottom surface of one of the support legs of one of the supports, wherein said leg base is protruded upwards to have a space part in a lower side, and a cut-away part corresponding to a shape of the bottom of the support leg.

11. The portable assembly type flat bench according to claim 6, wherein at least one of the supports has horizontal bridge to connect the plurality of vertical legs, wherein a hole is formed at a central portion of the bridge, and wherein an elongate structure is inserted into the hole of the bridge of the supports to interconnect another of the supports.

12. The portable assembly type flat bench according to claim 6, wherein a plate-shaped leg support member is disposed beneath at least one of the supports, wherein each of the legs of the at least one support is inserted in a cut-away portion formed in the leg support member, wherein a shape of each cut-away portion corresponds to a shape of a bottom of one of the legs.

13. The portable assembly type flat bench according to claim 6, wherein a leg base is engaged at a bottom surface of one of the support legs of one of the supports, wherein said leg base is protruded upwards to have a space part in a lower side, and a cut-away part corresponding to a shape of the bottom of the support leg.

14. The portable assembly type flat bench according to claim 1, wherein at least one of the supports has horizontal bridge to connect the plurality of vertical legs, wherein a hole is formed at a central portion of the bridge, and wherein an elongate structure is inserted into the hole of the bridge of the supports to interconnect another support.

15. The portable assembly type flat bench according to claim 1, wherein a plate-shaped leg support member is disposed beneath at least one of the supports, wherein each leg of the at least one support is inserted in each cut-away portion formed in the leg support, wherein a shape of each cut-away portion corresponds to a shape of a bottom of one of the legs.

16. The portable assembly type flat bench according to claim 1, wherein a leg base is engaged at a bottom surface of one of the support legs of one of the supports, wherein said leg base is protruded upwards to have a space part in a lower side, and a cut-away part corresponding to a shape of the bottom of the support leg.

* * * * *